US005732849A

United States Patent [19]

Brooks

[11] Patent Number: 5,732,849

[45] **Date of Patent: *Mar. 31, 1998**

[54] REVERSIBLE LAP TOP TV TRAY

[76] Inventor: Howard L. Brooks, 3219 S. 121st St., Omaha, Nebr. 68144

[ * ] Notice: The term of this patent shall not extend beyond the expiration date of Pat. No. Des. 366,780.

[21] Appl. No.: 596,645

[22] Filed: Feb. 5, 1996

Related U.S. Application Data

[63] Continuation-in-part of Ser. No. 19,433, Mar. 2, 1994, Pat. No. Des. 366,780.

[51] Int. Cl.[6] ..... B65D 11/00

[52] U.S. Cl. ..... 220/603; 220/17.1; 220/737

[58] Field of Search ..... 220/17.1, 603, 220/737

[56] References Cited

U.S. PATENT DOCUMENTS

| | | | |
|---|---|---|---|
| D. 301,820 | 6/1989 | Wasserman | D7/38 |
| D. 349,426 | 8/1994 | Norris | D7/553 |
| 3,498,268 | 3/1970 | Sleith et al. | 220/603 |
| 3,498,470 | 3/1970 | Thomas | 211/74 |
| 4,052,944 | 10/1977 | Jennings | 108/43 |
| 4,096,966 | 6/1978 | Korshak | 220/603 |
| 4,537,646 | 8/1985 | Hoyle | 156/212 |
| 4,700,634 | 10/1987 | Mills et al. | 108/43 |
| 4,788,916 | 12/1988 | Saxton | 108/43 |
| 4,815,623 | 3/1989 | Levin | 220/17.1 |
| 5,081,936 | 1/1992 | Drieling | 108/43 |
| 5,090,334 | 2/1992 | Sutton | 108/43 |
| 5,134,930 | 8/1992 | Mei-Hwa | 108/42 |
| 5,218,912 | 6/1993 | Buske | 108/26 |

*Primary Examiner*—Joseph Moy

*Attorney, Agent, or Firm*—Zarley, McKee, Thomte, Voorhees & Sease; Mark D. Frederiksen

[57] ABSTRACT

A reversible lap top TV tray includes a flexible fabric housing with a rigid tray removably mounted within a depression in the top wall in the housing. The housing is substantially filled with a lightweight flowable granular material, so as to conform the housing to the shape of a support. A cup holder is removably connected through a hole in the tray to permit attachment of the cup holder to either the top or bottom surface of the tray, thereby permitting reversibility of the tray in the housing depression. A generally cylindrical rim portion extending around the depression retains the tray in position within the depression in the housing.

7 Claims, 3 Drawing Sheets

REVERSIBLE LAP TOP TV TRAY

CROSS-REFERENCE TO RELATED APPLICATION

The present application is a continuation-in-part of Ser. No. 29/019,433, filed Mar. 2, 1994, now U.S. Pat. No. D 366,780.

TECHNICAL FIELD

The present invention relates generally to portable serving trays, and more particularly to a serving tray for holding meals with a reversible tray surface having a cup holder removably attached thereto.

BACKGROUND OF THE INVENTION

Serving trays which are supported on a consumer's lap have been utilized for many years to enable the person to sit and eat comfortably without requiring a table.

However, prior art serving trays suffer a number of drawbacks. First, those trays which include a cup holder are not reversible. Thus, the left-handed person typically must position a cup awkwardly on the tray.

Another drawback of prior art serving trays is the difficulty in thoroughly cleaning the tray after use.

Yet another problem with many serving trays is the select surface upon which the place setting is supported on the tray. Any tipping of the tray will cause the plate, cups, silverware and all other items to slide about the tray and spill.

SUMMARY OF THE INVENTION

It is therefore a general object of the present invention to provide an improved reversible lap top TV tray.

Another object is to provide a lap top tray which is reversible to permit location of a cup holder in more than one position.

Still another object of the present invention is to provide a lap top serving tray which is easily cleaned.

Still another object is to provide a lightweight serving tray which may be supported on a lap and which is economical to manufacture and refined in appearance.

These and other objects will be apparent to those skilled in the art.

The reversible lap top TV tray of the present invention includes a flexible fabric housing with a rigid tray removably mounted within a depression in the top wall in the housing. The housing is substantially filled with a lightweight flowable granular material, so as to conform the housing to the shape of a support. A cup holder is removably connected through a hole in the tray to permit attachment of the cup holder to either the top or bottom surface of the tray, thereby permitting reversibility of the tray in the housing depression. A generally cylindrical rim portion extending around the depression retains the tray in position within the depression in the housing.

DESCRIPTION OF THE PREFERRED EMBODIMENT

Figure 1:
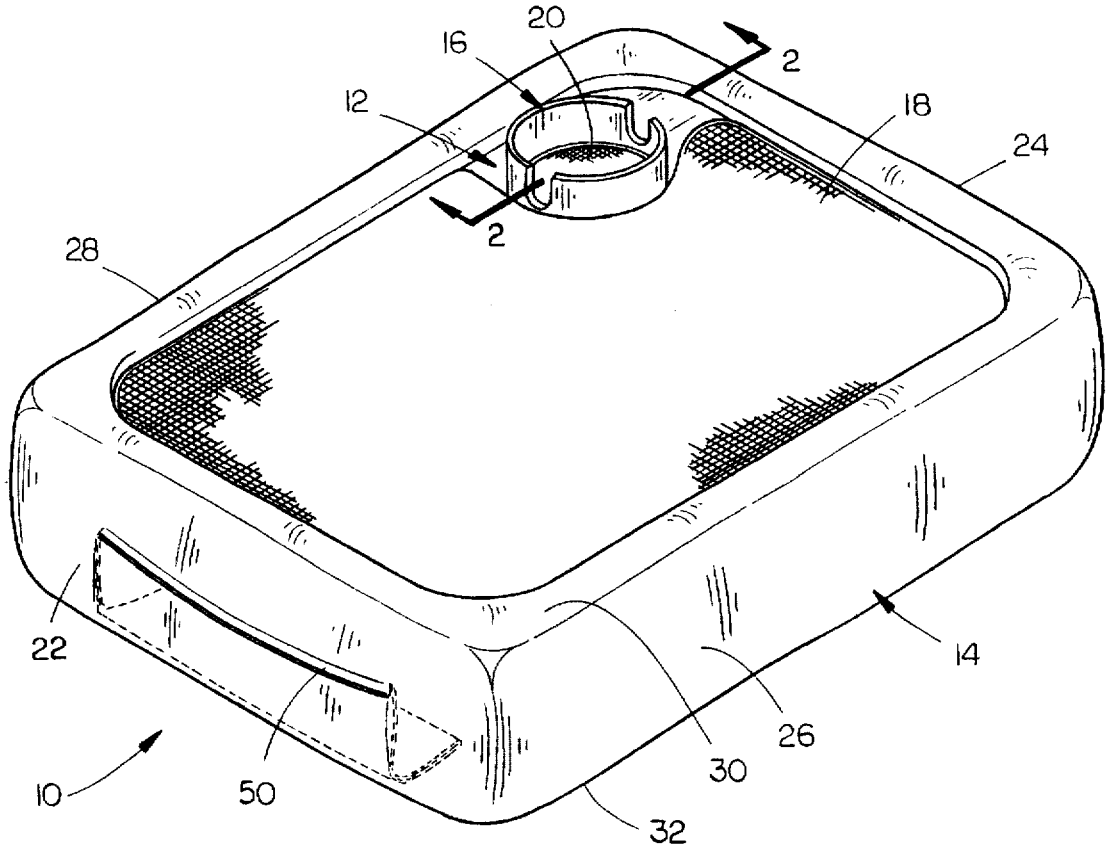
FIG. 1 is a perspective view of present invention.

Referring now to the drawings, in which similar or corresponding parts are identified with the same reference numeral and more particularly to FIG. 1, the lap top TV tray of the present invention is designated generally at 10 and includes a rigid removable tray 12 supported on a bag 14 and having a removable cup holder 16 attached thereto. A non-skid mat 18 is laid atop tray 12 to prevent dishes and the like from moving on the tray. A similar mat 20 is placed in cup holder 16 to prevent sliding of a cup therein.

Figure 2:
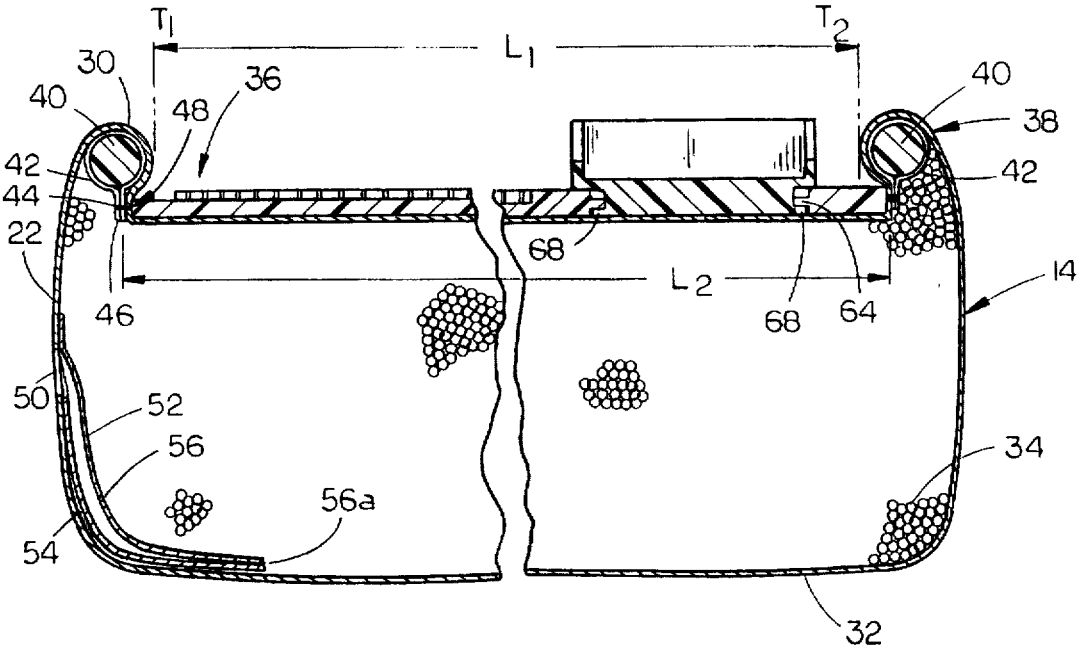
FIG. 2 is a sectional view taken at lines 2—2 in FIG. 1.

As shown in FIG. 1, bag 14 includes forward and rearward end walls 22 and 24, opposing longitudinal side walls 26 and 28, and top and bottom walls 30 and 32 respectively. Walls 22–32 are preferably formed of vinyl or other flexible fabric which is sewed together to form a bag-like enclosure 14. As shown in FIG. 2, bag 14 is substantially filled with a lightweight flowable granular material with a suitable density and looseness to permit the fabric of bag 14 to be adjusted to conform to the contour and shape of the consumer's lap or other supporting surface. The filler material 34 may be expanded foam plastic material, expanded beads or particles, expanded polyurethane beads or granules, or similar types of materials.

Figure 3:
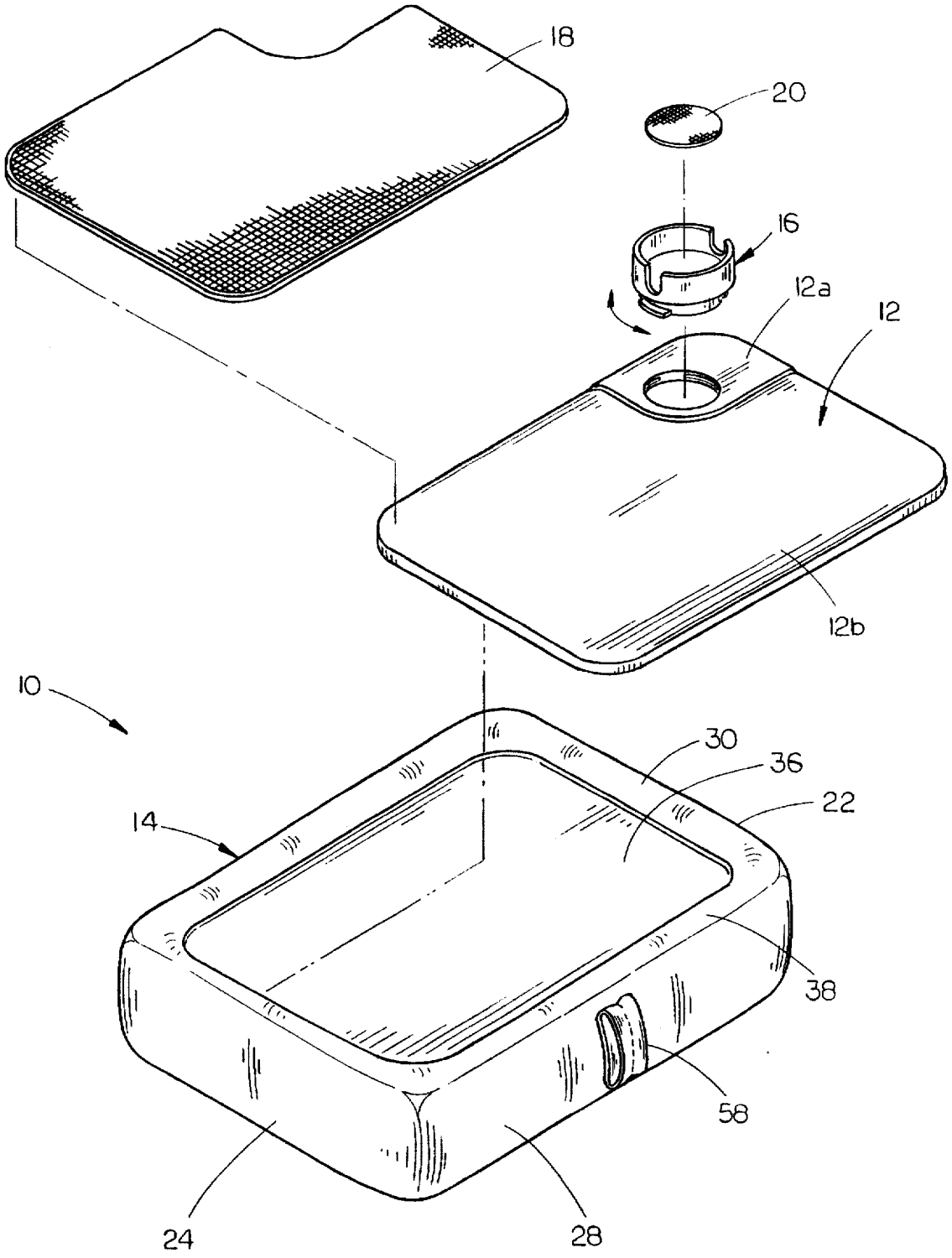
FIG. 3 is an exploded perspective view taken from the opposite side of the support bag.

A generally rectangular depression 36 is formed in the top wall 30 of bag 14, as shown in FIG. 3, with an upwardly projecting rim 38 extending entirely around depression 36. As shown in FIG. 2, rim 38 is formed by attaching a lightweight flexible rope 40 around the circumference of an interior surface **30*a* of top wall 30. Rope 40 is preferably encased within a sleeve 42 of fabric having a pair of flaps connected together to form a seam 46. Seam 46 is then affixed to top wall 30 to form rim 38. It should be noted that seam 46 is preferably oriented at the lower most tangent of rope 40, extending longitudinally along rope 40, such that a side wall of the cylindrical shape of rope 40 overhangs the depression to form a nip 48 which extends around the perimeter of depression 36. As discussed in more detail hereinbelow, nip 48 will receive and hold tray 12 is position within depression 36**.

Referring to FIGS. 1 and 2, a slot 50 is formed in forward end wall 22, generally parallel to and midway between top and bottom walls 30 and 32. A first sheet 52 is attached along the upper edge of slot 50 and a second sheet 54 is attached along the lower edge of slot 50, sheets 52 and 54 extending within the interior of bag 14. Sheets 52 and 54 are connected together along opposing side edges, but left unattached at their inwardly extending ends, to form a pocket 56 with an open end **56*a*. Sheets 52 and 54 preferably have a length greater than the distance slot 50 is located above bottom wall 32, such that the open end 56*a* extends inwardly from forward wall 22 into the interior of bag 14. Pocket open end 56*a* permits the introduction of the filler material 34 within bag 14. It can be seen that the force of the filler material 34 within bag 14 will cause the free ends of sheets 52 and 54 to be compressed together, preventing the escape of the filler material once introduced within bag 14. Because the pocket open end 56*a* is compressed together, a pocket is formed adjacent forward wall 22 by sheets 52 and 54**.

Referring once again to FIG. 3, bag 14 is shown in a reversed orientation, so that rearward end wall 24 and side wall 28 may be seen. A strap 58 is formed into a loop and affixed in a generally vertical orientation on side wall 28, preferably midway between end walls 22 and 24. Strap 58 serves as a handle, such that TV tray 10 may be easily transported. In addition, strap 58 may be utilized to secure the TV tray in a desired position. For example, an elongated strip of material may be threaded through the loop of strap 58 and the ends of the strip secured to the arms of a chair or wheelchair, so as to maintain bag 14 in position on the lap of a handicapped person.

Tray 12 is preferably a flat and rigid rectangular sheet having dimensions permitting a snug fit within depression 36 on bag 14. As shown in FIG. 2, the distance between vertical tangents $T_1$ and $T_2$ (designated $L_1$), the tangents being located on proximal side walls of rope 40 on opposite ends of top wall 30, is less than the length $L_2$ of depression 36. Length $L_1$ is less than length $L_2$ because of the location of the attachment of rope 40 to top wall 30. It can be seen that the width of depression 36 is similarly greater than the width of the distance between those portions of rim 38 at the upper end of side walls 26 and 28. In this way, tray 12 will fit snugly within the nip 48 formed around the perimeter of depression 36, with the overhanging side wall of rim 38 maintaining the tray in position within the depression. On the other hand, tray 12 may be easily removed by pushing rim 38 outwardly so that it pivots about the seam 46.

Figure 4:
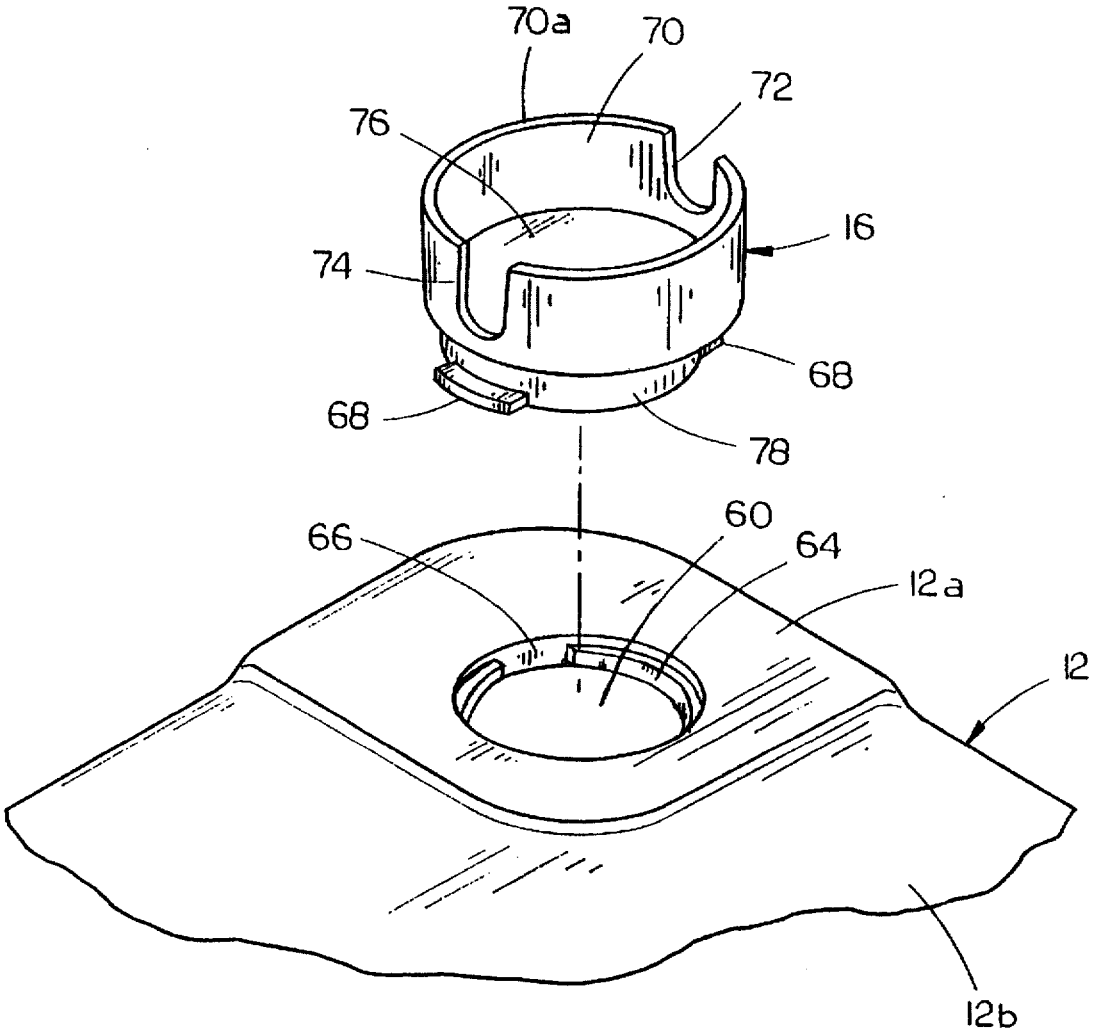
FIG. 4 is an enlarged exploded perspective view of the cup holder and a portion of the tray for receiving the cup holder.

Referring once again to FIG. 3, tray 12 has a corner portion 12*a* which is built up to be thicker than the remaining portion 12*b* of tray 12. FIG. 4 shows that a circular hole 60 is formed in corner portion 12*a* to receive cup holder 16. Hole 60 includes an annular side wall 62 with an annular flange 64 projecting radially inwardly therefrom. Flange 64 preferably has a thickness approximately one-third the thickness of corner portion 12*a*, and is centered between top and bottom surfaces of corner portion 12*a* as shown in FIG. 2. Flange 64 has a pair of opposing brakes or spaces 66 therein which will receive a pair of projecting lips 68 on cup holder 16, as shown in FIG. 4.

Cup holder 16 includes a cylindrical side wall 70 with a pair of opposing notches 72 and 74 formed therein which extend downwardly from an upper edge 70*a*. Notches 72 and 74 will receive the handle of a conventional cup or coffee mug. A flat bottom 76 is formed at the lower end of side wall 70 to support the mug thereon. A cylindrical support 78 depends from the lower end of cup holder 16 and has a diameter slightly less than the diameter of hole 60 so that it may be journaled therethrough. Lips 68 project diametrically from the lower end of support 78, as shown in FIG. 4.

Side wall 70 of cup holder 16 preferably has a diameter greater than the diameter of hole 60, so as to support cup holder 16 on the upper surface of corner portion 12*a*. Cup holder 16 is locked in position by rotating the cup holder 16 to align lips 68 with spaces 66 and inserting support 78 into hole 60. Cup holder 16 is then rotated so that lips 68 slide beneath flanges 64, as shown in FIG. 2. This interconnection of cup holder 16 with tray 12 permits simple and easy removal of cup holder 16 from the tray, to permit tray 12 to be flipped over and cup holder 16 inserted and locked in position on the opposite side of the tray. Thus, tray 12 may be reversed so as to locate the cup holder 16 at any one of the four corners of depression 36 (see FIG. 3). Obviously, other types of interconnection of cup holder 16 with tray 12 would work equally as well, including a threaded support 78 and interiorly threaded hole 60.

Nonskid mats 18 and 20 are preferably a lightweight mesh material having a rubber-like coating to permit the mats to be laid in position on tray 12 and cup holder bottom 76, to prevent movement of dishes thereon.

Whereas the lap top TV tray of the present invention has been shown and described in connection with the preferred embodiment thereof, many modifications, substitutions and additions may be made which are within the intended broad scope of the appended claims.

I claim:

1. A reversible serving tray, comprising:

a flexible fabric housing having a top wall, bottom wall, forward and rearward end walls, and opposing side walls;

said housing substantially filled with a lightweight flowable granular material;

a rigid, generally planar tray having first and second opposing faces, opposing end walls and opposing side walls, removably connected to the housing top wall; and a cup holder selectively removably connected to the tray, said cup holder including an upper cup supporting portion and a lower support portion, the lower portion having means for releasably connecting the cup holder to the tray with the upper portion projecting upwardly from either one of said first and second faces.

2. The serving tray of claim 1, wherein said means for releasably connecting the cup holder to the tray includes:

a hole extending from the tray first surface to the tray second surface, through a thickness of the tray;

said cup holder upper portion having a diameter greater than a diameter of the hole;

said cup holder lower portion having a diameter less than the diameter of the hole; and means along a side wall of the hole cooperable with means on a side wall of the cup holder lower portion for releasably connecting the cup holder to the tray.

3. The serving tray of claim 2, wherein said tray includes a corner portion having a thickness greater than the remainder of the tray, and wherein said hole is located in the corner portion.

4. The serving tray of claim 1, wherein said housing top wall has a depression formed generally centrally therein, surrounded by a rim portion, the depression having a shape and dimensions to receive said tray therein.

5. The serving tray of claim 4, further comprising means for movably connecting the tray to the housing, including said rim having an inwardly directed side wall overhanging the depression to prevent vertical movement of the tray when the tray is positioned in the depression.

6. The serving tray of claim 5, wherein said rim is generally cylindrical in shape.

7. The serving tray of claim 5, wherein said rim includes an elongated rope attached to the housing on an interior surface of the top wall, and attached continuously around the depression.

* * * * *